US010826218B2

(12) United States Patent
Schrameyer et al.

(10) Patent No.: US 10,826,218 B2
(45) **Date of Patent: *Nov. 3, 2020**

(54) THERMALLY INSULATING ELECTRICAL CONTACT PROBE

(71) Applicant: Varian Semiconductor Equipment Associates, Inc., Gloucester, MA (US)

(72) Inventors: Michael A. Schrameyer, Gloucester, MA (US); Steven M. Anella, Gloucester, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 360 days.

This patent is subject to a terminal disclaimer.

(21) Appl. No.: 15/863,292

(22) Filed: Jan. 5, 2018

(65) Prior Publication Data

US 2018/0131115 A1 May 10, 2018

Related U.S. Application Data

(63) Continuation of application No. 14/692,031, filed on Apr. 21, 2015, now Pat. No. 9,887,478.

(51) Int. Cl.
*H01R 13/24* (2006.01)
*H05B 3/06* (2006.01)
*H05B 3/14* (2006.01)

(52) U.S. Cl.
CPC ..... *H01R 13/2421* (2013.01); *H05B 3/06* (2013.01); *H05B 3/143* (2013.01)

(58) Field of Classification Search
CPC ..... H05B 3/06; H05B 3/143; H01R 13/2421
USPC ..... 219/209
See application file for complete search history.

(56) References Cited

U.S. PATENT DOCUMENTS 2,043,777 A * 6/1936 Schellenger ..... H01C 10/32 338/132
2,284,132 A * 5/1942 Chereton ..... D06F 79/026 337/359
2,337,457 A * 12/1943 Dzus ..... F16B 5/10 411/555
2,713,173 A 7/1955 Runcie
(Continued)

FOREIGN PATENT DOCUMENTS

CN 1262842 C 7/2006
CN 101095212 A 12/2007
(Continued)

*Primary Examiner* — Eric S Stapleton

(57) ABSTRACT

A thermally insulating electrical contact probe including a mounting plate having a tubular pin guide defining a pin pass-through, a cover coupled to the mounting plate and having a neck portion enclosing the pin guide, and an insulating pin having a shank portion disposed within the pin pass-through and defining a conductor pass-through, a flange portion extending radially outwardly from the shank portion above a top of the pin guide, and a pocket portion extending from the flange portion and defining a pocket. The electrical contact probe may further include a spring disposed intermediate the flange portion and the mounting plate, the spring biasing the flange portion away from the mounting plate, an electrical contact pad disposed within the pocket, and an electrical conductor coupled to the electrical contact pad and extending through the conductor pass-through.

10 Claims, 4 Drawing Sheets

(56) References Cited

U.S. PATENT DOCUMENTS 2,716,173 A * 8/1955 Russell ..... H01H 37/52 337/35
2,723,340 A * 11/1955 Boggs ..... H05B 3/82 392/457
2,742,543 A * 4/1956 Hurd ..... H01H 37/60 200/461
2,765,421 A * 10/1956 Robertson ..... H01J 23/50 315/3.5
2,923,785 A * 2/1960 Longenecker ..... F02P 7/02 200/19.22
2,946,905 A * 7/1960 Jolly ..... G10K 1/067 310/34
2,997,682 A * 8/1961 Grimes ..... H01R 13/629 439/372
3,056,879 A * 10/1962 Fischer ..... H05B 3/06 392/457
3,059,168 A * 10/1962 Sones ..... H02K 11/042 322/59
3,108,172 A * 10/1963 Edwards ..... F23Q 7/00 219/265
3,109,997 A * 11/1963 Giger ..... H01R 24/46 333/124
3,223,960 A * 12/1965 Ruehlemann ..... H01R 9/16 439/751
3,247,344 A * 4/1966 Russell ..... H01H 50/76 335/81
3,295,092 A * 12/1966 Newman ..... H01R 24/40 439/50
3,341,851 A * 9/1967 Tracey ..... G01P 1/127 346/7
3,345,561 A * 10/1967 Martin ..... G01J 5/20 324/95
3,387,116 A * 6/1968 Dupuis ..... H05B 3/141 219/541
3,416,125 A * 12/1968 Theve ..... H01R 24/52 439/638
3,502,834 A * 3/1970 Field ..... H02B 13/00 218/140
3,733,568 A * 5/1973 Prouty ..... H01H 3/503 335/186
3,761,871 A * 9/1973 Teurlings ..... H01R 13/428 439/751
3,764,871 A 10/1973 Scheuer et al.
3,835,296 A * 9/1974 Middough ..... F27D 11/02 219/553
3,889,133 A * 6/1975 Oka ..... G01R 15/002 327/429
3,932,711 A * 1/1976 O'Brien ..... G01H 3/00 381/152
4,017,714 A * 4/1977 Kreiser ..... C23F 13/02 204/196.14
4,022,594 A * 5/1977 Baysek ..... B03C 3/86 96/90
4,032,775 A * 6/1977 Bobrick ..... 362/426
4,058,701 A * 11/1977 Gruber ..... B60N 3/14 219/270
4,097,919 A * 6/1978 Bobrick ..... 362/270
4,145,107 A * 3/1979 De Haitre ..... H01R 4/24 439/801
4,178,495 A * 12/1979 Spisak ..... B23K 9/202 219/98
4,211,625 A * 7/1980 Vandevier ..... C23F 13/02 204/196.05
4,238,788 A * 12/1980 Rosauer ..... G08B 17/11 250/381
4,313,792 A * 2/1982 Smith ..... G21C 17/102 376/247
4,323,871 A * 4/1982 Kamp ..... H01H 85/46 337/144
4,359,764 A * 11/1982 Block ..... H01Q 1/50 333/23
4,388,947 A * 6/1983 Steuerwald ..... F16L 37/23 137/557
4,434,449 A * 2/1984 Dickey ..... H01T 4/06 337/34
4,488,209 A * 12/1984 Gosswiller ..... B60Q 7/00 248/422
4,513,214 A * 4/1985 Dieringer ..... H02K 5/148 310/112
4,513,347 A * 4/1985 Wilcox ..... H05F 3/02 361/212
4,518,477 A * 5/1985 Wright ..... G01N 27/404 165/177
4,528,439 A * 7/1985 Marney, Jr. ..... A45C 11/20 165/902
4,560,926 A * 12/1985 Cornu ..... G01R 1/067 324/72.5
4,568,804 A * 2/1986 Luehring ..... H01H 33/66207 174/50.52
4,575,694 A * 3/1986 Lapke ..... H01R 24/46 200/51.1
4,734,051 A * 3/1988 Burns ..... H01R 13/7036 439/289
4,848,616 A * 7/1989 Nozaki ..... F24H 9/0047 204/196.11
4,897,043 A * 1/1990 Giringer ..... H01R 13/2421 439/482
4,904,213 A * 2/1990 Hock ..... G01R 1/067 439/482
4,904,935 A * 2/1990 Calma ..... G01R 1/07328 324/559
4,918,384 A * 4/1990 Giringer ..... H01R 11/18 324/72.5
4,935,696 A * 6/1990 DiPerna ..... G01R 1/07378 324/72.5
5,009,613 A * 4/1991 Langgard ..... H01R 11/18 439/482
5,067,906 A * 11/1991 Woodgate ..... F21V 21/12 439/115
5,149,282 A * 9/1992 Donato ..... F21V 15/04 248/160
5,167,520 A * 12/1992 Henry ..... H01R 13/6315 439/248
5,290,980 A * 3/1994 Cummings ..... H01H 19/58 200/11 R
5,335,311 A * 8/1994 Groothuizen ..... H05B 3/82 204/196.11
5,387,138 A * 2/1995 O'Malley ..... H01R 13/405 439/751
5,548,164 A * 8/1996 Hillard ..... B60R 25/04 180/287
5,557,213 A * 9/1996 Reuter ..... G01R 1/06722 324/755.05
5,598,318 A * 1/1997 Dewitt ..... G06F 1/18 361/679.57
5,628,644 A * 5/1997 Szalay ..... H01R 13/193 439/263
5,641,315 A * 6/1997 Swart ..... G01R 1/06722 324/72.5
5,727,954 A * 3/1998 Kato ..... H01R 13/2421 439/66
5,749,754 A * 5/1998 Patterson ..... H01R 13/2421 439/76.1
5,771,974 A * 6/1998 Stewart ..... E21B 34/045 166/336
5,804,984 A * 9/1998 Alcoe ..... G01R 1/06733 324/750.16
5,898,983 A * 5/1999 Sooy ..... H05K 13/0473 29/33 M
5,899,753 A * 5/1999 Wong ..... H01R 39/643 439/17
5,936,421 A * 8/1999 Stowers ..... G01R 15/12 324/750.27
5,936,581 A * 8/1999 Roshitsh ..... H01P 1/10 200/51.1
5,980,266 A * 11/1999 Hsu ..... H01R 13/2421 439/37

(56) References Cited

U.S. PATENT DOCUMENTS 6,019,164 A * 2/2000 Getchel ..... H01L 21/67103 118/728
6,068,499 A * 5/2000 Kuriyama ..... H01R 24/46 439/188
6,071,144 A * 6/2000 Tang ..... H01R 13/52 439/426
6,112,769 A * 9/2000 Nicholson ..... F16L 33/225 138/109
6,140,830 A * 10/2000 Ott ..... G01R 1/07328 324/755.05
6,146,168 A * 11/2000 Ishii ..... H01R 13/7031 439/188
6,153,859 A * 11/2000 Taylor ..... A47J 27/21041 219/439
6,159,056 A * 12/2000 Boyle ..... G01R 1/06722 439/700
6,190,181 B1 * 2/2001 Affolter ..... H01R 13/2421 439/70
6,205,160 B1 * 3/2001 Grewell ..... H01S 5/02264 372/36
6,208,158 B1 * 3/2001 Schein ..... G01R 1/07328 324/755.05
6,222,377 B1 * 4/2001 Kato ..... G01R 1/06722 324/750.25
6,224,407 B1 * 5/2001 Duquerroy ..... H01R 13/6315 439/188
6,271,672 B1 * 8/2001 Swart ..... G01R 1/06722 324/755.05
6,328,096 B1 * 12/2001 Stone ..... H01L 21/67103 118/728
6,350,155 B1 * 2/2002 Mullinger-Bausch ..... H01R 35/04 439/675
6,365,349 B1 * 4/2002 Moynihan ..... B01J 19/0046 435/287.2
6,377,059 B2 * 4/2002 Vinther ..... G01R 1/06722 324/72.5
6,390,826 B1 * 5/2002 Affolter ..... H01R 13/2421 439/70
6,424,163 B1 * 7/2002 Ott ..... G01R 1/07328 324/754.14
6,439,906 B1 * 8/2002 Gray ..... H01R 24/46 439/188
6,464,511 B1 * 10/2002 Watanabe ..... G01R 1/07371 439/66
6,511,335 B1 * 1/2003 Rayssiguier ..... H01R 13/523 439/191
6,533,594 B1 * 3/2003 Kurup ..... B23K 11/362 439/191
6,554,630 B2 * 4/2003 Uratani ..... H01R 24/46 439/188
6,561,848 B1 * 5/2003 Khemakhem ..... H01R 9/0512 439/550
6,575,786 B1 * 6/2003 Khemakhem ..... H01R 13/5804 439/578
6,634,902 B1 * 10/2003 Pirovic ..... H01R 13/53 439/241
6,679,724 B2 * 1/2004 Hillman ..... H01R 13/523 285/93
6,685,150 B2 * 2/2004 Anderson ..... H04R 1/026 248/201
6,702,613 B2 * 3/2004 Khemakhem ..... H01R 13/5804 439/578
6,716,038 B2 * 4/2004 Garcia ..... H01R 13/2421 439/75
6,716,043 B2 * 4/2004 Ishizuka ..... H01R 13/2421 439/131
6,737,878 B2 * 5/2004 Kagami ..... G01R 1/06738 324/755.01
6,783,395 B2 * 8/2004 Khemakhem ..... H01R 9/0512 439/550
6,788,966 B2 * 9/2004 Kenan ..... A61B 5/0536 600/372
6,808,021 B2 * 10/2004 Zimmerman ..... E21B 47/0001 166/381
6,809,535 B2 * 10/2004 Campbell ..... G01R 1/06738 324/149
6,837,724 B2 * 1/2005 McDaid ..... H01R 24/46 439/188
6,844,749 B2 * 1/2005 Sinclair ..... G01R 1/0466 324/755.05
6,846,988 B2 * 1/2005 Khemakhem ..... H01R 9/032 174/652
6,878,016 B2 * 4/2005 Wulff ..... H01R 13/2471 439/700
6,881,082 B2 * 4/2005 Jordan ..... H01R 13/7033 439/188
6,884,114 B2 * 4/2005 Khemakhem ..... H01R 13/5804 439/580
6,923,688 B1 * 8/2005 Burson ..... H01R 13/2421 439/218
6,929,484 B2 * 8/2005 Weiss ..... H01R 13/2414 439/66
6,932,620 B2 * 8/2005 Ishiguro ..... H01Q 1/1271 439/66
6,935,906 B2 * 8/2005 Orihara ..... H01R 13/2421 439/289
6,951,489 B2 * 10/2005 Sekiguchi ..... H01R 13/2421 439/700
6,957,986 B2 * 10/2005 Jing ..... H01R 13/2421 439/700
6,974,340 B2 * 12/2005 Zech ..... H01R 24/46 439/141
7,029,325 B2 * 4/2006 Khemakhem ..... H01R 9/0512 439/550
7,094,112 B2 * 8/2006 Arai ..... H01R 13/187 439/482
7,114,957 B2 * 10/2006 Duquerroy ..... H01R 9/0515 439/63
7,134,878 B2 * 11/2006 Zheng ..... H01R 13/2421 439/65
7,140,105 B2 * 11/2006 Campbell ..... G01R 1/06738 29/874
7,140,912 B2 * 11/2006 Khemakhem ..... H01R 13/5804 439/578
7,197,821 B2 * 4/2007 Khemakhem ..... H01R 9/032 29/857
7,217,142 B1 * 5/2007 Wu ..... H01R 13/5804 439/607.41
7,261,162 B2 * 8/2007 Deans ..... E21B 41/0007 166/250.01
7,279,912 B2 * 10/2007 Leon ..... G01R 1/06738 324/755.11
7,281,948 B2 * 10/2007 Khemakhem ..... H01R 13/5804 439/580
7,285,026 B1 * 10/2007 Ju ..... H01R 13/2421 439/700
7,295,013 B2 * 11/2007 Conti ..... G01V 3/083 324/350
7,298,153 B2 * 11/2007 Farris ..... G01R 1/06794 324/754.05
7,361,038 B2 * 4/2008 Duquerroy ..... H01R 13/703 200/51.1
7,480,991 B2 * 1/2009 Khemakhem ..... H01R 9/032 29/857
7,585,194 B2 * 9/2009 Ito ..... H01R 13/2421 439/824
7,602,203 B2 * 10/2009 Takekoshi ..... G01R 1/06727 324/754.07
7,626,408 B1 * 12/2009 Kaashoek ..... G01R 1/06722 324/755.05
7,736,202 B1 * 6/2010 Kaiser ..... H01R 13/2421 439/824
7,762,852 B2 * 7/2010 Daly ..... H01R 9/2491 439/562
7,837,518 B2 * 11/2010 Nicholson ..... H01R 13/523 439/730

(56) References Cited

U.S. PATENT DOCUMENTS 8,493,085 B2 * 7/2013 Barabi ..... G01R 31/286 324/754.11
8,840,423 B2 * 9/2014 Hoshi ..... H01R 13/648 361/679.4
8,900,000 B2 * 12/2014 Cairns ..... H01R 35/04 439/13
8,986,043 B2 * 3/2015 Hirakawa ..... H01R 24/46 439/188
9,046,568 B2 * 6/2015 Ho ..... G01R 1/06722
9,059,545 B2 * 6/2015 Mason ..... H01R 12/714
9,184,533 B2 * 11/2015 Wyatt ..... H02G 1/10
9,246,272 B2 * 1/2016 Kitchen ..... H01R 13/641
9,310,395 B2 * 4/2016 Lee ..... G01R 1/06722
9,887,478 B2 * 2/2018 Schrameyer ..... H05B 3/143
2001/0005645 A1 * 6/2001 Zech ..... H01R 24/46 439/188
2002/0022397 A1 * 2/2002 Hillman ..... H01R 13/523 439/489
2002/0123271 A1 * 9/2002 Henry ..... H01R 13/2421 439/700
2002/0160637 A1 * 10/2002 Ishizuka ..... H01R 13/2421 439/131
2003/0089699 A1 * 5/2003 Hiramatsu ..... H01L 21/67109 219/444.1
2003/0135999 A1 * 7/2003 Khemakhem ..... H01R 9/032 29/857
2003/0211777 A1 * 11/2003 Khemakhem ..... H01R 13/5804 439/580
2004/0022388 A1 * 2/2004 Chan ..... H01R 13/2421 379/455
2004/0023530 A1 * 2/2004 Garcia ..... H01R 13/2421 439/75
2004/0023554 A1 * 2/2004 Khemakem ..... H01R 9/0512 439/580
2004/0077225 A1 * 4/2004 Chun-Fu ..... H01R 13/2471 439/700
2004/0161971 A1 * 8/2004 Khemakhem ..... H01R 13/5804 439/580
2004/0219807 A1 * 11/2004 Weiss ..... H01R 13/2414 439/91
2005/0022387 A1 2/2005 Severa et al.
2005/0161246 A1 * 7/2005 Khemakhem ..... H01R 9/032 174/75 C
2005/0176293 A1 * 8/2005 Khemakhem ..... H01R 13/5804 439/578
2005/0189115 A1 * 9/2005 Rytlewski ..... E21B 19/146 166/344
2006/0003626 A1 * 1/2006 Roberts ..... G01V 1/201 439/483
2006/0063426 A1 * 3/2006 Khemakhem ..... H01R 9/0512 439/580
2006/0226842 A1 * 10/2006 Conti ..... G01V 3/083 324/353
2007/0037446 A1 * 2/2007 Khemakhem ..... H01R 13/5804 439/578
2007/0175027 A1 * 8/2007 Khemakhem ..... H01R 9/032 29/857
2007/0224889 A1 * 9/2007 Ito ..... H01R 13/2421 439/824
2008/0265563 A1 * 10/2008 Nicholson ..... H01R 13/523 285/31
2009/0047815 A1 * 2/2009 Nicholson ..... H01R 13/5202 439/281
2009/0295388 A1 * 12/2009 Zhang ..... G01R 33/3628 324/313
2010/0254426 A1 * 10/2010 Okamoto ..... G01K 1/14 374/141
2012/0142210 A1 * 6/2012 Di Stefano ..... H01R 4/48 439/374
2013/0101241 A1 * 4/2013 Hou ..... C23C 16/4586 384/32
2013/0330944 A1 * 12/2013 Rucki ..... H01R 12/714 439/81
2014/0014644 A1 * 1/2014 Akiba ..... H01L 21/67103 219/444.1
2014/0251208 A1 9/2014 Samir et al.
2014/0332161 A1 * 11/2014 Ricci ..... H01L 21/67103 156/345.27
2016/0315407 A1 * 10/2016 Schrameyer ..... H05B 3/143
2019/0109397 A1 * 4/2019 Sugiura ..... H01R 13/08

FOREIGN PATENT DOCUMENTS

CN 101495668 A 7/2009
CN 101305285 B 9/2011
CN 102435927 A 5/2012
CN 103828035 A 5/2014
TW M475066 U 3/2014
TW 201429079 A 7/2014
TW 2014-47227 A 12/2014
WO 2006078585 A2 7/2006
WO 2013085254 A1 6/2013
WO 2014143505 A1 9/2014

* cited by examiner

THERMALLY INSULATING ELECTRICAL CONTACT PROBE

CROSS-REFERENCE TO RELATED APPLICATIONS

This application is a Continuation and claims priority to and the full benefit of U.S. Non-Provisional application Ser. No. 14/692,031 filed on Apr. 21, 2015 and titled "Thermally Insulating Electrical Contact Probe," the entire contents of which are incorporated herein by reference.

FIELD OF THE DISCLOSURE

Embodiments of the present disclosure relate to the field of electrical connection devices, and more particularly to a thermally insulating electrical contact probe.

BACKGROUND OF THE DISCLOSURE

Ion implantation is a technique for introducing conductivity-altering impurities into a substrate such as a wafer or other workpiece. A desired impurity material is ionized in an ion source of an ion beam implanter, the ions are accelerated to form an ion beam of prescribed energy, and the ion beam is directed at the surface of the substrate. The energetic ions in the ion beam penetrate into the bulk of the substrate material and are embedded into the crystalline lattice of the material to form a region of desired conductivity.

In some ion implant processes, a desired doping profile is achieved by implanting ions into a target substrate at high temperatures. Heating a substrate can be achieved by supporting the substrate on a heated platen during an ion implant process. A conventional heated platen may be connected to an electrical power source via a plurality of electrical contact probes. Additional electrical contact probes may be connected to the heated the platen for enabling electrostatic clamping of a substrate.

During operation, the various electrical contact probes connected to a heated platen may absorb heat from the heated platen and may reduce the temperature of the heated platen in localized areas adjacent to the electrical contact probes. As will be appreciated, any temperature variations in the material of the heated platen may affect the uniformity of heat transferred to a target substrate supported and heated by the heated platen, potentially having an adverse effect on an ion implant process. In some instances, temperature variations in a heated platen can cause the heated platen to warp, bow, or even crack.

In view of the foregoing, there is a need to mitigate heat losses via electrical connections in heated platens in order to achieve uniform platen temperatures.

SUMMARY

This Summary is provided to introduce a selection of concepts in a simplified form. This Summary is not intended to identify key features or essential features of the claimed subject matter, nor is it intended as an aid in determining the scope of the claimed subject matter.

An exemplary embodiment of a thermally insulating electrical contact probe for providing an electrical connection to a heated platen in accordance with the present disclosure may include a mounting plate having a tubular pin guide defining a pin pass-through, a cover coupled to the mounting plate and having a neck portion enclosing the pin guide, and an insulating pin having a shank portion disposed within the pin pass-through and defining a conductor pass-through, a flange portion extending radially outwardly from the shank portion above a top of the pin guide, and a pocket portion extending from the flange portion and defining a pocket. The electrical contact probe may further include a spring disposed intermediate the flange portion and the mounting plate, the spring biasing the flange portion away from the mounting plate, an electrical contact pad disposed within the pocket, and an electrical conductor coupled to the electrical contact pad and extending through the conductor pass-through.

Another exemplary embodiment of a thermally insulating electrical contact probe for providing an electrical connection to a heated platen in accordance with the present disclosure may include a mounting plate having a tubular pin guide defining a pin pass-through, a cover coupled to the mounting plate and having a neck portion enclosing the pin guide, a mounting boss extending from the mounting plate and through a through-hole in the cover, a first insulating washer disposed on a top surface of the mounting plate and having a flange extending into a radial gap intermediate the mounting boss and the cover, a second insulating washer disposed on a top surface of the cover and having a flange extending into the radial gap intermediate the mounting boss and the cover, and an insulating pin having a shank portion disposed within the pin pass-through and defining a conductor pass-through, a flange portion extending radially outwardly from the shank portion above a top of the pin guide, and a pocket portion extending from the flange portion and defining a pocket. The electrical contact probe may further include a coil spring surrounding the pin guide and disposed intermediate the flange portion and the mounting plate, the spring biasing the flange portion away from the mounting plate, an electrical contact pad disposed within the pocket, and an electrical conductor coupled to the electrical contact pad and extending through the conductor pass-through.

An exemplary embodiment of a heated platen assembly in accordance with the present disclosure may include a heated platen, a base coupled to the heated platen, a heat shield disposed intermediate, and coupled to, the heated platen and the base, an electrical contact probe coupled to the base and extending through the base and the heat shield, the electrical contact probe including a mounting plate having a tubular pin guide defining a pin pass-through, a cover coupled to the mounting plate and having a neck portion enclosing the pin guide, and an insulating pin having a shank portion disposed within the pin pass-through and defining a conductor pass-through, a flange portion extending radially outwardly from the shank portion above a top of the pin guide, and a pocket portion extending from the flange portion and defining a pocket. The heated platen assembly may further include an electrical contact pad disposed within the pocket, an electrical conductor coupled to the electrical contact pad and extending through the conductor pass-through, and a spring disposed intermediate the flange portion and the mounting plate, the spring biasing the flange portion away from the mounting plate and holding the electrical contact pad in engagement with a metallization layer on a backside of the heated platen.

BRIEF DESCRIPTION OF THE DRAWINGS

By way of example, various embodiments of the disclosed apparatus will now be described, with reference to the accompanying drawings, wherein.

DETAILED DESCRIPTION

Figure 1A:
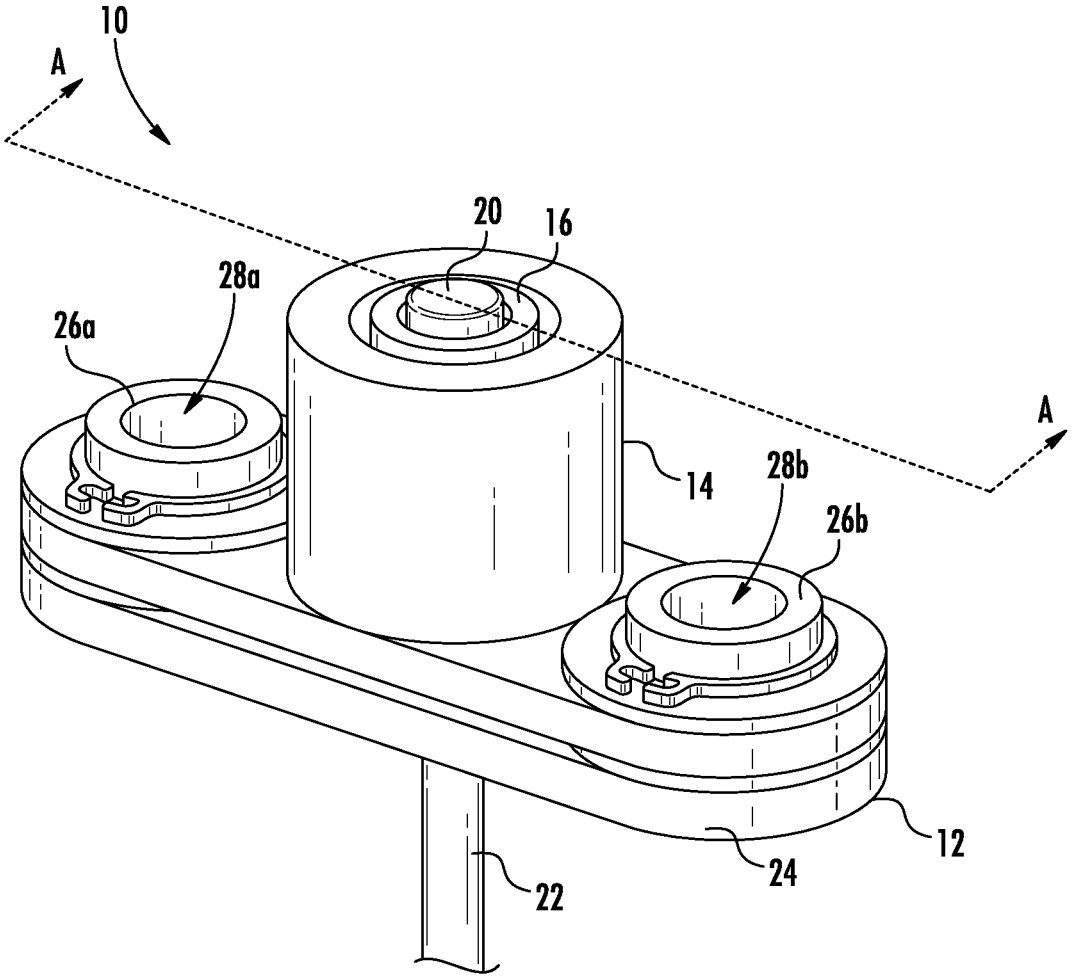
FIG. 1*a* is perspective view illustrating an exemplary embodiment of a thermally insulating electrical contact probe in accordance with the present disclosure.
Figure 1B:
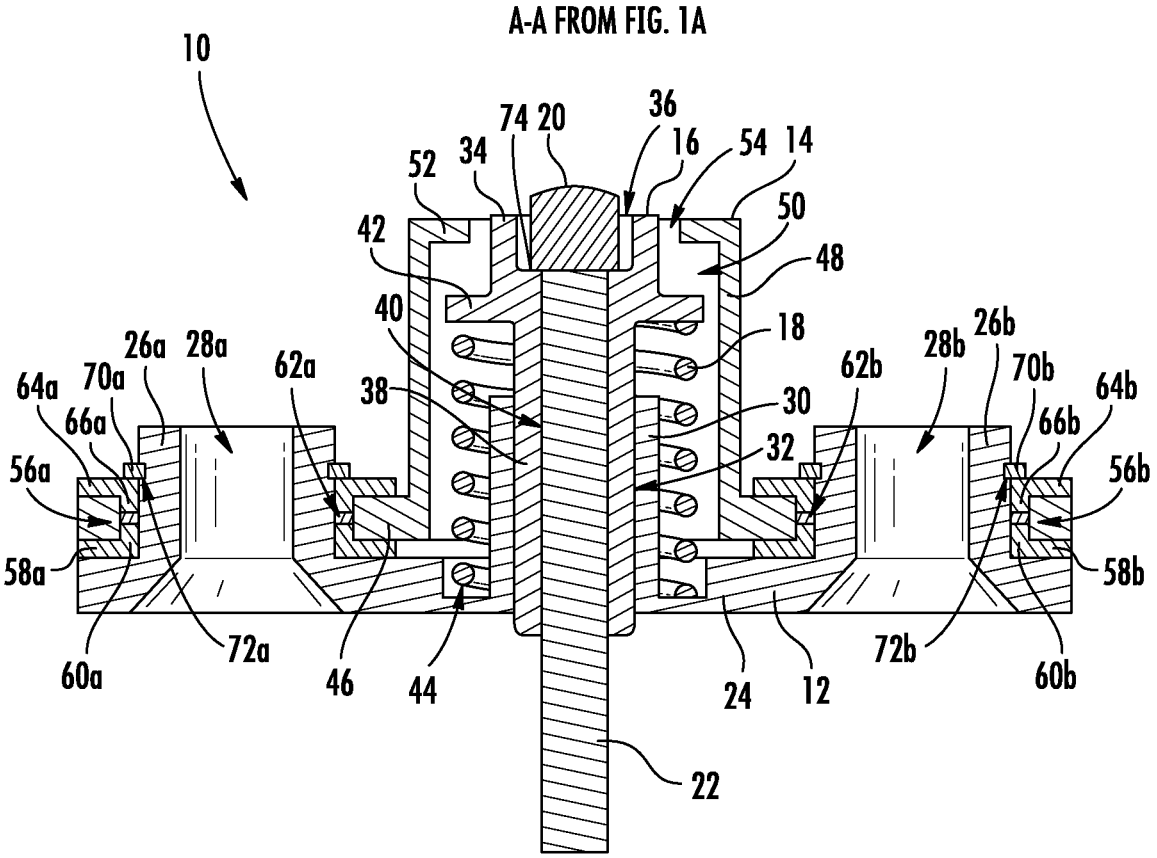
FIG. 1*b* is cross-sectional view illustrating the thermally insulating electrical contact probe shown in FIG. 1*a* taken along plane A-A.

Referring to FIGS. 1*a* and 1*b*, an exemplary embodiment of a thermally-insulating electrical contact probe 10 (hereinafter "the probe 10") in accordance with the present disclosure is shown. The probe 10 may be provided for establishing an electrical connection between an electrical power source and a heated platen of an ion implanter, such as for heating the platen or for facilitating electrostatic clamping of a substrate disposed on the heated platen. During operation, the probe 10 may be operable to minimize an amount of heat absorbed from the heated platen to mitigate temperature variations across the heated platen. As will be appreciated, the probe 10 may be implemented in a heated platen used to support a substrate during processing thereof. For example, the heated platen may be used to support a substrate during an ion implant process, a plasma deposition process, an etching process, a chemical-mechanical planarization process, or generally any process where a semiconductor substrate is to be supported on a heated platen. As such, an exemplary heated platen assembly is described below. The embodiments of the present disclosure are not limited by the exemplary heated platen assembly described herein and may find application in any of a variety of other platen applications used in a variety of semiconductor manufacturing processes.

The probe 10 may generally include a mounting plate 12, a cover 14, an insulating pin 16, a coil spring 18 (FIG. 1*b*), an electrical contact pad 20, and an electrical conductor 22. For the sake of convenience and clarity, terms such as "top," "bottom," "upper," "lower," "vertical," "horizontal," "lateral," "longitudinal," "radial," "inner," and "outer" may be used herein to describe the relative placement and orientation of the components of the probe 10 with respect to the geometry and orientation of the probe 10 as it appears in FIGS. 1*a* and 1*b*. Said terminology will include the words specifically mentioned, derivatives thereof, and words of similar import.

The mounting plate 12 of the probe 10 may include a generally planer base portion 24 having a pair of tubular mounting bosses 26*a*, 26*b* extending from a top surface thereof. The mounting bosses 26*a*, 26*b* may define respective fastener pass-throughs 28*a*, 28*b* extending through the mounting plate 12 for accepting corresponding mechanical fasteners as further described below. The base portion 26 may further have a tubular pin guide 30 (FIG. 1*b*) extending from a top surface thereof intermediate the mounting bosses 26*a*, 26*b*. The pin guide 30 may define a pin pass-through 32 extending through the mounting plate 12 for accepting the insulating pin 16 and the electrical conductor 22 as further described below. The mounting plate 12 may be formed of a high-temperature capable, thermally and electrically insulating material, such as Zirconia, Alumina, various thermoplastics, etc.

Referring to FIG. 1*b*, the insulating pin 16 may be a generally tubular member having a pocket portion 34 defining a pocket 36, a shank portion 38 extending from a bottom of the pocket portion 34 and defining a conductor pass-through 40 extending from a bottom of the pocket 36, and a flange portion 42 extending radially-outwardly from a top of the shank portion 38. The conductor pass-through 40 may be coaxial with, and may have a smaller diameter than, the pocket 36. The insulating pin 16 may be formed of a high-temperature capable, thermally and electrically insulating material, such as Zirconia, Alumina, various thermoplastics, etc.

The spring 18 may be a coil spring formed of a high-temperature capable metal. The spring 18 may surround and may extend above the pin guide 30, and may be seated within an annular trench 44 in the mounting plate 12 for preventing excessive horizontal movement of the spring 18 relative to the mounting plate 12. The flange portion 42 of the insulating pin 16 may be seated on top of the spring 18, and the shank portion 38 of the insulating pin 16 may extend down through the pin pass-through 32 of the pin guide 30 and may protrude from the bottom of the mounting plate 12. An outer diameter of the shank portion 38 may be smaller (e.g., at least 0.0015 inches smaller) than the diameter of the pin pass-through 32 to establish a free-running, locational clearance fit between the shank portion 38 and the pin guide 30. Thus, the shank portion 38 may freely move vertically within the pin pass-through 32, and may also shift or tilt horizontally within the pin pass-through 32 as further described below.

The cover 14 of the probe 10 may be formed of a low-emissivity material, such as aluminum or nickel. The cover 14 may be disposed on top of the mounting plate 12 and may include a generally planar base portion 46 and a generally tubular neck portion 48 extending from a top surface of the base portion 46. The neck portion 48 may define an internal chamber 50 housing the pin guide 30, the insulating pin 16, and the spring 18. An annular flange 52 may extend radially inwardly from a top of the neck portion 48 and may define an aperture 54 having a diameter greater than the outer diameter of the pocket portion 34 of the insulating pin 16 and smaller than the outer diameter of the flange portion 42 of the insulating pin 16.

The base portion 46 of the cover 14 may include a pair of through-holes 56*a*, 56*b* for receiving the mounting bosses 26*a*, 26*b* of the mounting plate 12 therethrough, respectively. A first pair of lower insulating washers 58*a*, 58*b* may be seated on top of the base portion 24 of the mounting plate 12 surrounding the mounting bosses 26*a*, 26*b*, respectively, and may have respective flanged portions 60*a*, 60*b* extending into radial gaps 62*a*, 62*b* intermediate the mounting bosses 26*a*, 26*b* and the cover, respectively. Similarly, a second pair of upper insulating washers 64*a*, 64*b* may be seated on top of the base portion 46 of the cover 14 surrounding the mounting bosses 26*a*, 26*b*, respectively, and may have respective flanged portions 66*a*, 66*b* extending into the radial gaps 62*a*, 62*b*, respectively. A pair of retaining rings 70*a*, 70*b* may be removably disposed within respective grooves 72*a*, 72*b* in the outer surfaces of mounting bosses 26*a*, 26*b* above the upper insulating washers 64*a*, 64*b*, thus securing the upper insulating washers 64*a*, 64*b*, the base portion 46 of the cover 14, and the lower insulating washers 58*a*, 58*b* against the base portion 24 of the mounting plate 12 in a vertically stacked arrangement. The lower insulating washers 58*a*, 58*b* and the upper insulating washers 64*a*, 64*b* may be formed of a low thermal conductivity material, such as Alumina, Zirconia, various thermoplastics, etc., for mitigating conductive heat transfer between the cover 14 and the mounting plate 12 as further described below.

The electrical contact pad 20 may be made from a thermally durable, electrically conducting material, such as nickel, and may be soldered or brazed to the electrical conductor 22. The electrical contact pad 20 may be disposed within the pocket 36 of the pocket portion 34 of the insulating pin 16, and the electrical conductor 22 may extend through the conductor pass-through 40 of the shank portion 38 of the insulating pin 16 and may be coupled to an electrical power source (not shown). The electrical contact pad 20 may have a diameter greater (e.g., at least 0.010 inches greater) than the diameter of the conductor pass-through 40 and smaller (e.g., at least 0.010 inches smaller) than the diameter of the pocket 36. Thus, the electrical contact pad 20 may rest on an annular shoulder 74 defined at the juncture of the pocket 36 and the conductor pass-through 40, with the shoulder 74 acting as a lower travel stop for retaining the electrical contact pad 20 within the pocket 36.

Figure 2:
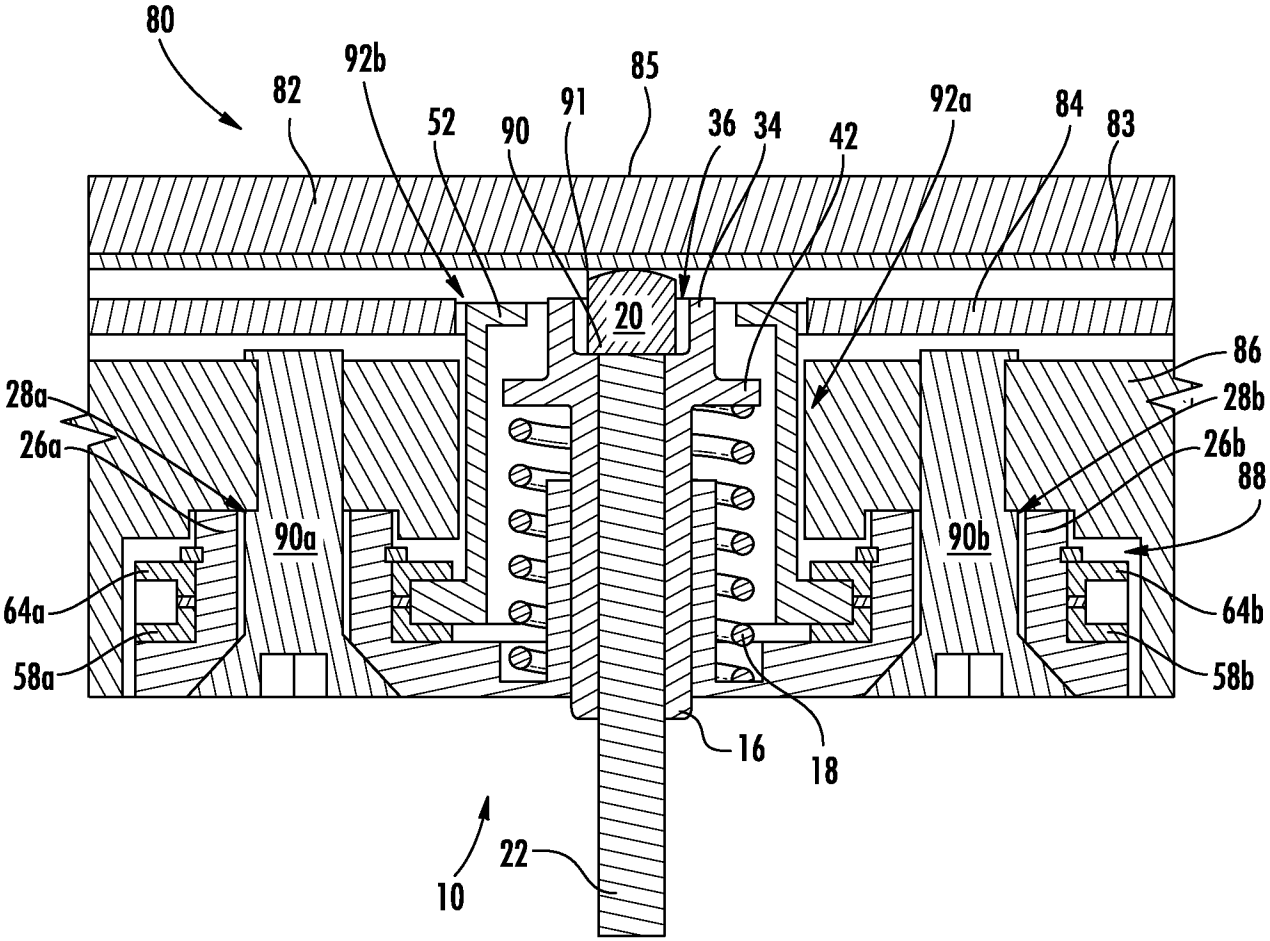
FIG. 2 is cross-sectional view illustrating an exemplary embodiment of a heated platen assembly in accordance with the present disclosure including the thermally insulating electrical contact probe shown in FIGS. 1*a* and 1*b*.

FIG. 2 is a cross-sectional view illustrating an embodiment of the probe 10 installed in an exemplary heated platen assembly 80. The heated platen assembly 80 may include a heated platen 82, a metallization layer 83, a heat shield 84, and a base 86 coupled together in a vertically-spaced, stacked relationship, in any of a variety of known manners.

The metallization layer 83 may include a plurality of metallic traces printed on or otherwise applied to the underside or backside of the heated platen 82 and covered with a layer of glass or other electrically insulating material. When an electric current is applied to the metallization layer 83, the metallization layer 83 may convert an amount of the electrical energy into heat. This heat may be conducted through the heated platen 82, thus heating a substrate disposed thereon.

The heat shield 84 may function to reduce an amount of heat transferred from the heated platen 82 to the relatively cold base 86. The heat shield 84 may thus be configured to reflect heat back toward the heated platen 82, away from the base 86.

The heated platen 82 may be formed of a thermally durable material, including a ceramic material such as alumina, aluminum nitride, boron nitride or a similar dielectric ceramic. The heat shield 84 may be formed of a thermally-reflective material, such as aluminum, stainless steel, titanium, or other low emissivity metal. The base 86 may be formed of any suitably rigid and durable material and may be part of, or may be coupled to, a scanning mechanism (not shown) capable of orienting the platen 82 at various angular and/or rotational positions during processing operations.

The probe 10 may be disposed within a complementary recess 88 in a bottom of the base 86 and may be removably fastened to the base 86 by a pair of mechanical fasteners 90*a*, 90*b* (e.g., screws or bolts) extending through the fastener pass-throughs 28*a*, 28*b* in the mounting bosses 26*a*, 26*b*, respectively. The neck portion 48 of the cover 14 may extend upwardly through respective apertures 92*a*, 92*b* in the base 86 and the heat shield 84.

The spring 18 of the probe 10 may be held in compression between the mounting plate 12 and the flange portion 42 of the insulating pin 16, and may thus urge the insulating pin 16 upwardly, away from the mounting plate 12. The insulating pin 16, and particularly the shoulder 74 in the pocket portion 34 of the insulating pin 16, may in-turn urge the electrical contact pad 20 upwardly against the metallization layer 83. Thus, the spring 18 may allow the electrical contact pad 20 and the insulating pin 16 to be displaced vertically, such as may occur when a substrate is loaded onto, or removed from, the support surface 85 of the heated platen 82, while holding the electrical contact pad 20 in firm engagement with the metallization layer 83 to maintain a desired electrical connection between the electrical conductor 22 and the metallization layer 83. The flange 52 of the neck portion 48 of the cover 14 may act as an upper travel stop for limiting upward movement of the insulating pin 16, and the pin guide 30 of the mounting plate 12 may act as a lower travel stop for limiting downward movement of the insulating pin 16.

During operation of the platen assembly 80, electrical current may be applied to the metallization layer 83 via the electrical conductor 22 and the electrical contact pad 20. The electrical current may be provided for heating the heated platen 82 in the above-described manner, and/or for generating an electrostatic force for clamping a substrate to the support surface 85 of the heated platen 82. In either case, an amount of heat may be transferred from the heated platen 82 to the relatively cold base 86 via conductive and/or radiative heat transfer (convective heat transfer is generally prevented since the platen assembly 80 may be located in a processing environment held at vacuum). Significant heat transfer from the heated platen 82 to the base 86 is generally undesirable since such heat transfer may create temperature variations in the heated platen 82. As will be appreciated, any temperature variations in the material of the heated platen 82 may affect the uniformity of heat transferred to a target substrate supported by the heated platen 82, adversely affecting an ion implantation process. In some instances, temperature variations in the heated platen 82 may cause the heated platen 82 to warp, bow, or even crack.

The above-described structural features and configuration of the probe 10 may cooperate to mitigate heat transfer from the heated platen 82 to the relatively cold base 86, improving temperature uniformity in the heated platen 82. For example, the portion of the probe 10 in direct contact with the metallization layer 83 is merely the electrical contact pad 20, and the electrical contact pad 20 and the attached electrical conductor 22 are thermally insulated from the rest of the probe 10 by the insulating pin 16. This limited contact between the probe 10 and the metallization layer 83 may restrict conductive heat transfer from the heated platen 82 to the base 86 via the probe 10. Furthermore, since the diameter of the pocket 36 of the pocket portion 34 of the insulating pin 16 is larger than the diameter of the electrical contact pad 20, the bottom surface 90 of the electrical contact pad 20 is in contact with the insulating pin 16, with the sidewall 91 of the electrical contact pad 20 being radially spaced apart from the insulating pin 16. This limited contact between the electrical contact pad 20 and the insulating pin 16 may further restrict conductive heat transfer from the heated platen 82 to the base 86 via the probe 10. Still further, the above-described free-running fit between the shank portion 38 of the insulating pin 16 and the pin guide 30 results in minimal physical contact between the shank portion 38 and the pin guide 30. This may further restrict conductive heat transfer from the heated platen 82 to the base 86 via the probe 10. Still further, the lower insulating washers 58*a*, 58*b* and the upper insulating washers 64*a*, 64*b*, being formed of a low thermal conductivity material and entirely separating the cover 14 from the mounting plate 12, may restrict conductive transfer from the cover 14 to the mounting plate 12. This may further restrict conductive heat transfer from the heated platen 82 to the base 86 via the probe 10. Still further, the cover 14, being formed of a low-emissivity material, may act as a radiation shield between the heated platen 82 and the underlying components of the probe 10. This may restrict radiative heat transfer from the heated platen 82 to probe 10, in-turn mitigating conductive heat transfer from the probe 10 to the base 86.

In addition to mitigating heat transfer from the heated platen 82 to the relatively cold base 86, the above-described structural features and configuration of the probe 10 may cooperate to allow thermal expansion and contraction of the heated platen 82 relative to the base 86 while maintaining a desired electrical connection with the heated platen 82. For example, since the diameter of the pocket 36 of the pocket portion 34 of the insulating pin 16 is larger than the diameter of the electrical contact pad 20, the electrical contact pad 20 may be allowed to move horizontally within the pocket 36 when the heated platen 82 expands and contracts while maintaining the physical connection between the electrical contact pad 20 and the heated platen 82. Furthermore, since the outer diameter of the shank portion 38 of the insulating pin 16 is smaller than the diameter of the pin pass-through 32 in the pin guide 30, the insulating pin 16 may be allowed to tilt or rock horizontally within the pin guide 30 when the heated platen 82 expands and contracts while holding the electrical contact pad 20 in firm engagement with the heated platen 82.

Figure 3:
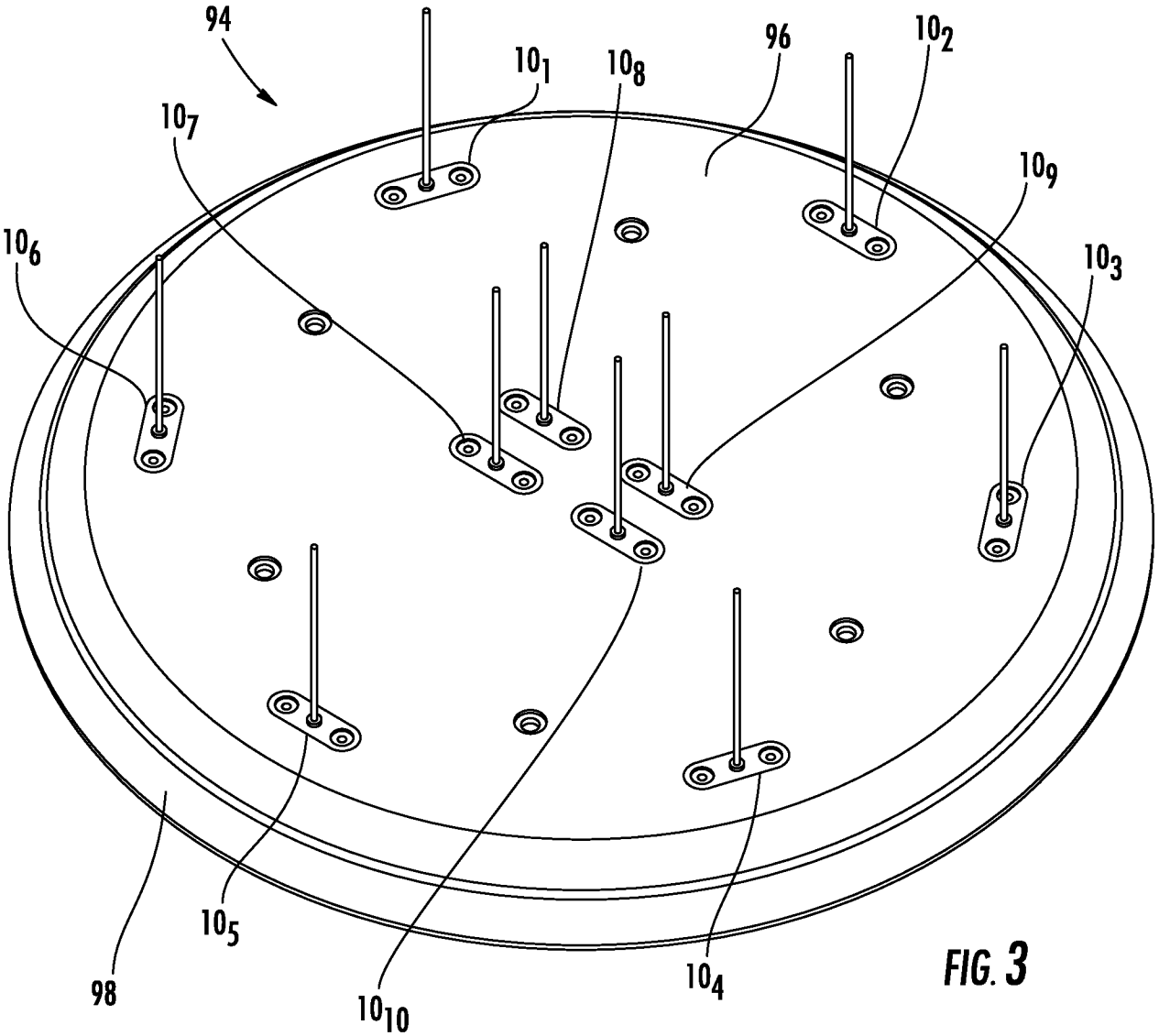
FIG. 3 is bottom perspective view illustrating an exemplary embodiment of a heated platen assembly in accordance with the present disclosure

In further embodiments, a plurality of electrical contact probes similar to the probe 10 described above may be implemented in a platen assembly in various configurations and arrangements to provide electrical connections for heating a platen, for enabling electrostatic clamping of substrates, and/or for facilitating various other features of a platen assembly requiring electrical power. For example, referring to the bottom perspective view of the platen assembly 94 shown in FIG. 3, a first plurality of electrical contact probes $\mathbf{10}_{1\text{-}6}$ similar to the probe 10 described above may be installed in a base 96 of the platen assembly 94 for enabling electrostatic clamping of substrates to a heated platen 98 of the platen assembly 94. A second plurality of electrical contact probes $\mathbf{10}_{7\text{-}10}$ similar to the probe 10 described above may be installed in the base 96 for heating the heated platen 98.

Thus, the above-described exemplary probe 10 may provide numerous advantages relative to conventional electrical contact probes commonly employed in platen assemblies for providing electrical connections to heated platens. For example, the probe 10 may greatly mitigate an amount of heat transferred from a heated platen to a relatively cold base of a heated platen assembly. This may improve temperature uniformity in a heated platen, thus improving the reliability of ion implant processes and reducing the likelihood of catastrophic platen failure. Additionally, the probe 10 may allow thermal expansion and contraction of a heated platen relative to a base of a heated platen assembly while maintaining a desired electrical connection to the heated platen. Still further, the probe 10 may operate effectively, and may confer all of the above-described advantages, within a vacuum environment of a heated platen assembly.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, while the present disclosure has been described herein in the context of a particular implementation in a particular environment for a particular purpose, those of ordinary skill in the art will recognize its usefulness is not limited thereto. Embodiments of the present disclosure may be beneficially implemented in any number of environments for any number of purposes. Accordingly, the claims set forth below must be construed in view of the full breadth and spirit of the present disclosure as described herein.

The invention claimed is:

1. A thermally insulating electrical contact probe comprising:

a mounting plate having a tubular pin guide defining a pin pass-through;

an insulating pin disposed within the pin pass-through and defining a conductor pass-through;

a spring disposed intermediate the mounting plate and a flange portion of the insulating pin, the spring biasing the flange portion away from the mounting plate;

an electrical contact pad supported by the insulating pin and protruding from the conductor pass-through, wherein the electrical contact pad is disposed within a pocket defined by the insulating pin, wherein a diameter of the pocket is at least 0.010 inches greater than a diameter of the electrical contact pad to allow the electrical contact pad to move horizontally within the pocket; and an electrical conductor coupled to the electrical contact pad and extending through the conductor pass-through.

2. The thermally insulating electrical contact probe of claim 1, wherein an annular shoulder is defined at a juncture of the pocket and the conductor pass-through, the shoulder providing a travel stop for limiting movement of the electrical contact pad.

3. The thermally insulating electrical contact probe of claim 1, wherein a diameter of the pin pass-through is at least 0.0015 inches greater than a diameter of a shank portion of the insulating pin that extends through the pin pass-through to establish a free-running fit between the shank portion and the pin guide and to allow the shank portion to tilt within the pin pass-through.

4. The thermally insulating electrical contact probe of claim 1, wherein the spring is a coil spring surrounding the pin guide.

5. The thermally insulating electrical contact probe of claim 4, wherein the spring is seated in an annular trench in the mounting plate.

6. A heated platen assembly comprising:

a heated platen;

a base coupled to the heated platen;

a heat shield disposed intermediate, and coupled to, the heated platen and the base; and an electrical contact probe coupled to the base and extending through the base and the heat shield, the electrical contact probe comprising:

a mounting plate having a tubular pin guide defining a pin pass-through;

an insulating pin disposed within the pin pass-through and defining a conductor pass-through;

an electrical contact pad supported by the insulating pin and protruding from the conductor pass-through, wherein the electrical contact pad is disposed within a pocket defined by the insulating pin, wherein a diameter of the pocket is at least 0.010 inches greater than a diameter of the electrical contact pad to allow the electrical contact pad to move horizontally within the pocket;

an electrical conductor coupled to the electrical contact pad and extending through the conductor pass-through; and a spring disposed intermediate the mounting plate and a flange portion of the insulating pin, the spring biasing the flange portion away from the mounting plate and holding the electrical contact pad in engagement with a metallization layer on a backside of the heated platen.

7. The heated platen assembly of claim 6, wherein an annular shoulder is defined at a juncture of the pocket and the conductor pass-through, the shoulder providing a travel stop for limiting movement of the electrical contact pad.

8. The heated platen assembly of claim 6, wherein a diameter of the pin pass-through is at least 0.0015 inches greater than a diameter of a shank portion of the insulating pin that extends through the pin pass-through to establish a free-running fit between the shank portion and the pin guide and to allow the shank portion to tilt within the pin pass-through.

9. The heated platen assembly of claim 6, wherein the spring is a coil spring surrounding the pin guide.

10. The heated platen assembly of claim 9, wherein the spring is seated in an annular trench in the mounting plate.

* * * * *